US009436206B2

(12) United States Patent
Liu

(10) Patent No.: US 9,436,206 B2
(45) Date of Patent: Sep. 6, 2016

(54) TEMPERATURE AND PROCESS COMPENSATED CURRENT REFERENCE CIRCUITS

(71) Applicant: STMicroelectronics (Shenzhen) R&D Co. Ltd, Shenzhen (CN)

(72) Inventor: Yong Feng Liu, Shenzhen (CN)

(73) Assignee: STMicroelectronics (Shenzhen) R&D Co. Ltd, Shenzhen (CN)

( * ) Notice: Subject to any disclaimer, the term of this patent is extended or adjusted under 35 U.S.C. 154(b) by 165 days.

(21) Appl. No.: 14/519,225

(22) Filed: Oct. 21, 2014

(65) Prior Publication Data

US 2015/0185754 A1 Jul. 2, 2015

(30) Foreign Application Priority Data

Jan. 2, 2014 (CN) ..... 2014 1 0007047

(51) Int. Cl.

| | |
|---|---|
| ***G05F 3/20*** | (2006.01) |
| ***G05F 3/26*** | (2006.01) |
| ***G05F 1/46*** | (2006.01) |
| *G05F 3/24* | (2006.01) |

(52) U.S. Cl.

CPC ..... *G05F 3/267* (2013.01); *G05F 1/463* (2013.01); *G05F 3/242* (2013.01)

(58) Field of Classification Search

CPC ..... G05F 3/24; G05F 3/242; G05F 3/245; G05F 3/26; G05F 3/262; G05F 3/267; G05F 1/461; G05F 1/463

See application file for complete search history.

(56) References Cited

U.S. PATENT DOCUMENTS

| | | | | |
|---|---|---|---|---|
| 4,636,742 | A | 1/1987 | Oritani | |
| 7,116,158 | B2 * | 10/2006 | Teel | G05F 3/30 323/313 |
| 7,495,505 | B2 * | 2/2009 | Chang | G05F 3/30 323/313 |
| 7,573,325 | B2 * | 8/2009 | Garcia | G05F 3/262 323/313 |
| 8,368,377 | B2 | 2/2013 | Liu | |
| 2009/0302825 | A1 * | 12/2009 | Hsieh | G05F 3/24 323/315 |
| 2012/0256605 | A1 | 10/2012 | Lecce et al. | |

FOREIGN PATENT DOCUMENTS

| | | |
|---|---|---|
| CN | 1271116 A | 10/2000 |

OTHER PUBLICATIONS

First Office Action and Search Report for CN 201410007047.0 dated Nov. 25, 2015 (6 pages).

* cited by examiner

*Primary Examiner* — Matthew Nguyen

(74) *Attorney, Agent, or Firm* — Gardere Wynne Sewell LLP

(57) ABSTRACT

A reference current path carries a reference current. A first transistor is coupled to the reference current path. A second transistor is also coupled to the reference current path. The first and second transistors are connected in parallel to carry the reference current. The first transistor is biased by a first voltage (which is a bandgap voltage plus a threshold voltage). The second transistor is biased by a second voltage (which is a PTAT voltage plus a threshold voltage). The first and second transistors are thus biased by voltages having different and opposite temperature coefficients with a result that the temperature coefficients of the currents flowing in the first and second transistors are opposite and the reference current accordingly has a low temperature coefficient.

22 Claims, 8 Drawing Sheets

TEMPERATURE AND PROCESS COMPENSATED CURRENT REFERENCE CIRCUITS

PRIORITY CLAIM

This application claims priority from Chinese Application for Patent No. 201410007047.0 filed Jan. 2, 2014, the disclosure of which is incorporated by reference.

TECHNICAL FIELD

This invention relates generally to electronic circuits, and more particularly to circuits for generating reference currents.

BACKGROUND

Reference is made to FIG. 1 which illustrates a conventional current reference generator circuit 10. The circuit 10 includes an operational amplifier 12 having a non-inverting (positive) input 14 and an inverting (negative) input 16. The non-inverting input 14 is configured to receive a reference voltage. In an exemplary implementation, the reference voltage is a bandgap reference voltage (VBG) generated by a bandgap voltage generator circuit (known to those skilled in the art). The amplifier 12 is powered from the positive and negative voltage supply nodes, in this case indicated as the voltage Vana3V3 (an analog circuit supply voltage for example of 3V) and ground. The amplifier includes an output node 18 coupled to the gate of a transistor 20. The transistor 20 is an n-channel MOSFET device. The source-drain path of the transistor 20 is coupled between the positive and negative voltage supply nodes. A transistor 22 has a source-drain path coupled in series with the transistor 20. The transistor 22 is a p-channel MOSFET device configured as a diode-connected device with its gate terminal connected to its drain terminal (this device supporting current replication and scaling through mirroring circuits as known in the art). The source terminal of transistor 22 is coupled to the positive voltage supply node. The source terminal of transistor 20 is coupled through a feedback path 24 to the inverting input 16 of the amplifier 12. A resistor 26 is coupled between the source terminal of transistor 20 (the inverting input 16 of amplifier 12) and the negative voltage supply node. The operational amplifier 12, through the negative feedback path 24, functions to drive the operation of the transistor 20 such that the voltage at the source terminal of transistor 20 equals the bandgap reference voltage (VBG). A reference current Iref (=VBG/R1) is accordingly generated in the source-drain path of transistor 20 through the resistor 26.

The spread of the bandgap reference voltage (VBG) is typically very small. However, the resistance of resistor R1 is dependent on process corner, and the spread of the resistance value with process variation may be higher than ±30%. This can lead to significant errors in the reference current generation. An improved current reference circuit that is better temperature and process compensated is needed.

SUMMARY

In an embodiment, a reference current path carries a reference current where a first and second transistor, coupled in parallel, are coupled in series with the reference current path. The first and second transistors are biased by different voltages, wherein those bias voltages have different and opposite temperature coefficients. For example, the first voltage is a bandgap voltage (plus a threshold) and the second voltage is a PTAT voltage (plus a threshold). As a result, the temperature coefficients of the currents flowing in the first and second transistors are opposite and the reference current will accordingly have a low temperature coefficient.

In an embodiment, a circuit comprises: a reference current path configured to carry a reference current; a first transistor coupled to the reference current path and configured to carry at first portion of the reference current, said first transistor having a control terminal configured to be biased by a first voltage; and a second transistor coupled to the reference current path and configured to carry a second portion of the reference current, said second transistor having a control terminal configured to be biased by a second voltage; wherein the first and second transistors are coupled in parallel with each other; and wherein a temperature coefficient of the current flowing in the first transistor and a temperature coefficient of the current flowing in the second transistor are opposite.

In an embodiment, a circuit comprises: an output transistor configured to carry a reference current; a first transistor coupled in series with the output transistor to carry a first portion of the reference current; a second transistor coupled in series with the output transistor to carry a second portion of the reference current; wherein the first and second transistors are coupled in parallel to each other; a bandgap reference voltage generator circuit configured to generate a bandgap reference voltage; a first biasing circuit configured to generate a first biasing voltage for application to a control terminal of the first transistor, said first biasing voltage derived from said bandgap reference voltage; and a second biasing circuit configured to generate a second biasing voltage for application to a control terminal of the second transistor, said second biasing voltage generated from a proportional to absolute temperature (PTAT) current mirrored from a current flowing in the bandgap reference voltage generator circuit; wherein a temperature coefficient of the current flowing in the first transistor and a temperature coefficient of the current flowing in the second transistor are opposite.

In an embodiment, a circuit comprises: a reference current path configured to carry a reference current; a first transistor coupled in series with the reference current path to carry the reference current; a second transistor coupled in series with the first transistor to the reference current; a bandgap reference voltage generator circuit configured to generate a bandgap reference voltage; a first biasing circuit configured to generate a first biasing voltage for application to a control terminal of the first transistor, said first biasing voltage derived from said bandgap reference voltage; and a second biasing circuit configured to generate a second biasing voltage for application to a control terminal of the second transistor, said second biasing voltage generated from a proportional to absolute temperature (PTAT) current mirrored from a current flowing in the bandgap reference voltage generator circuit.

The foregoing has outlined, rather broadly, features of the present disclosure. Additional features of the disclosure will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of embodiments of the present disclosure and are not necessarily drawn to scale. To more clearly illustrate certain embodiments, a letter indicating variations of the same structure, material, or process step may follow a figure number.

DETAILED DESCRIPTION OF THE DRAWINGS

Figure 2:
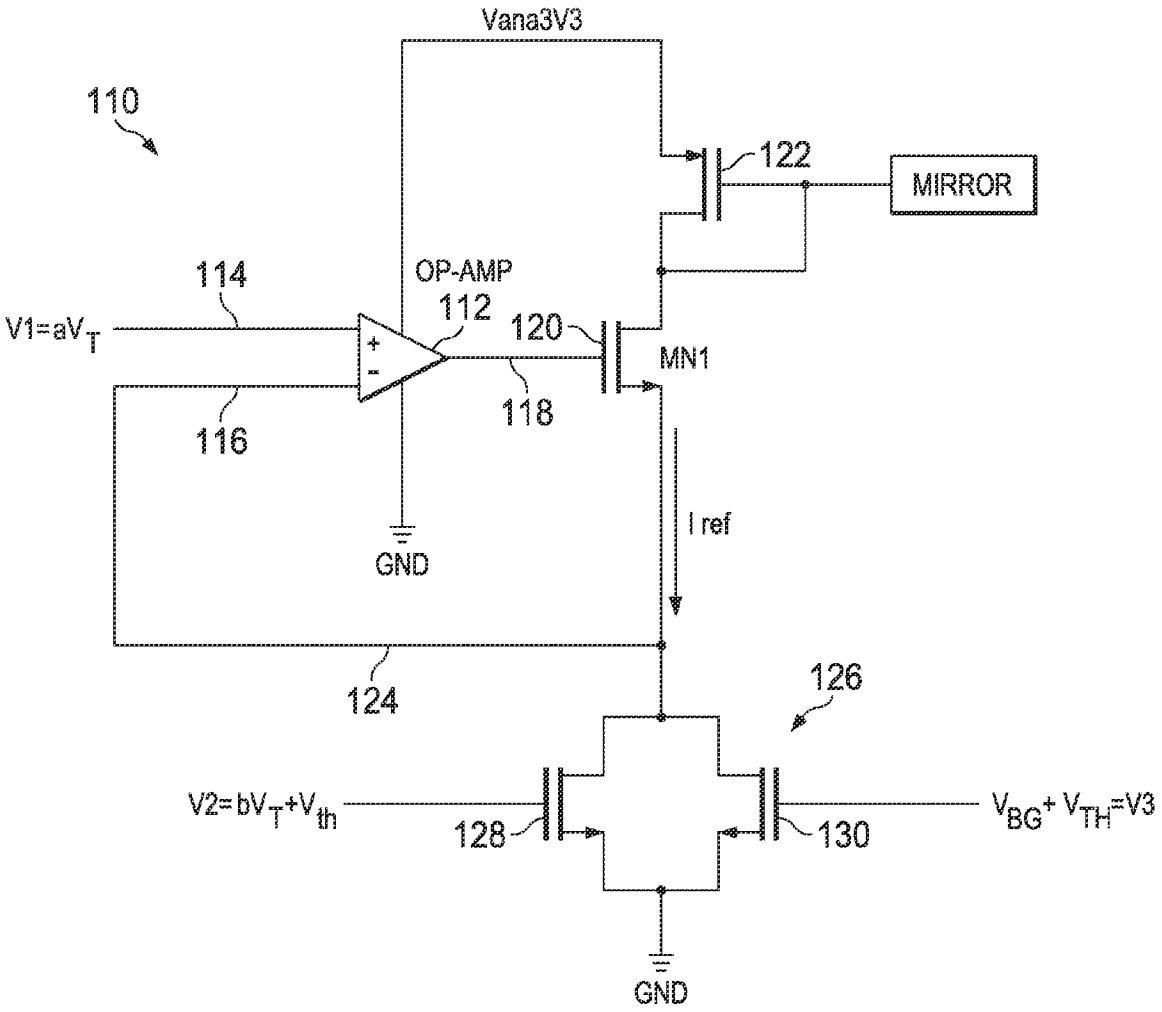
FIG. 2 is a circuit diagram of an embodiment of a temperature and process compensated reference current generator circuit.

Reference is now made to FIG. 2 which illustrates a circuit diagram of an embodiment of a temperature and process compensated reference current generator circuit 110. The circuit 110 includes an operational amplifier 112 having a non-inverting (positive) input 114 and an inverting (negative) input 116. The non-inverting input 114 is configured to receive a first reference voltage V1=a$V_T$. In this case, $V_T$=kT/q as known to those skilled in the art and a is a scaling constant set by the circuit designer for the reference voltage generator. The amplifier 112 is powered from the positive and negative voltage supply nodes, in this case indicated as the voltage Vana3V3 (an analog circuit supply voltage for example of 3V) and ground. The amplifier includes an output node 118 coupled to the gate of a transistor 120. The transistor 120 is an n-channel MOSFET device. The source-drain path of the transistor 120 is coupled between the positive and negative voltage supply nodes. A transistor 122 has its source-drain path coupled in series with the transistor 120. The transistor 122 is a p-channel MOSFET device configured as a diode-connected device with its gate terminal connected to its drain terminal (this device supporting current replication and scaling through mirroring circuits as known in the art). The source terminal of transistor 122 is coupled to the positive voltage supply node. The source terminal of transistor 120 is coupled through a feedback path 124 to the inverting input 116 of the amplifier 112. A resistive circuit 126 is coupled between the source terminal of transistor 120 (the inverting input 116 of amplifier 112) and the negative voltage supply node.

The resistive circuit 126 comprises a transistor 128 and transistor 130 coupled in parallel to each other and further coupled between the source terminal of transistor 120 (the inverting input 116 of amplifier 112) and the negative voltage supply node. The transistors 128 and 130 are n-channel MOSFET devices whose drain terminals are connected together and whose source terminals are connected together. The gate terminal of transistor 128 is configured to receive a second reference voltage V2=b$V_T$+$V_{th}$. Again, $V_T$=kT/q as known to those skilled in the art, b is a scaling constant set by the circuit designer for the reference voltage generator and Vth is the threshold voltage of a MOSFET device. The gate terminal of transistor 130 is configured to receive a third reference voltage V3=$V_{BG}$+$V_{th}$. The values a and b are temperature independent constants. The voltage $V_{BG}$ is a bandgap reference voltage generated by a bandgap voltage generator circuit (known to those skilled in the art). The voltages a$V_T$ and b$V_T$ can be derived from the bandgap reference voltage generator.

The operational amplifier 112, through the negative feedback path 124, functions to drive the operation of the transistor 120 such that the voltage at the source terminal of transistor 120 equals the first reference voltage V1. A reference current Iref (=V1/R126) is accordingly generated in the source-drain path of transistor 120 through the resistance 126. The value of the resistance 126 is a function of the on-resistance of transistor 128 in parallel with the on-resistance of transistor 130, and these devices are controlled by the applied biasing voltages V2 and V3 to operate in the triode region. Thus, the on-resistances of transistors 128 and 130 are dependent on V2 and V3.

The on-resistance of transistor 128 is given by the following equation:

$$R_{128} = \frac{1}{\mu_n C_{ox}\left(\frac{W}{L}\right)_{R128}(V_{GS} - V_{TH})} = \frac{1}{\mu_n C_{ox}\left(\frac{W}{L}\right)_{R128} bV_T} = \frac{1}{\beta_{R128} bV_T}$$

The on-resistance of transistor 130 is given by the following equation:

$$R_{130} = \frac{1}{\mu_n C_{ox}\left(\frac{W}{L}\right)_{R130}(V_{GS} - V_{TH})} = \frac{1}{\mu_n C_{ox}\left(\frac{W}{L}\right)_{R130} V_{BG}} = \frac{1}{\beta_{R130} V_{BG}}$$

Thus, the reference current Iref is given by the following equation:

$$Iref = \frac{aV_T}{R_{128}} + \frac{aV_T}{R_{130}} = aV_T\beta_{128}bV_T + aV_T\beta_{130}V_{BG} = ab\beta_{128}V_T^2 + a\beta_{130}V_{BG}V_T$$

It will accordingly be recognized that the temperature coefficient of the current in transistor 128 is $T^{2-n}$, while the temperature coefficient of the current in transistor 130 is $T^{1-n}$. In other words, dependent on the value of n, the transistors 128 and 130 can have opposite temperature coefficients. Thus, the temperature coefficient of the current flowing in the transistor 128 can be opposite the temperature coefficient of the current flowing in the transistor 130.

The value of β is given by:

$$\beta = \mu_n C_{ox}\left(\frac{W}{L}\right)$$

Wherein: $\mu_n$ is the mobility of average electrons is an n-channel MOSFET device, $C_{OX}$ is the capacitance of the oxide, and W and L are the width and length dimensions, respectively, of the transistor. The value for $\mu_n$:

$$\mu_n(T) = \mu_n(T_o)\left(\frac{T}{T_o}\right)^{-n}$$

Wherein: $\mu_n(T_o)$ is the value of $\mu_n$ at the reference temperature, and n is considered a constant independent of temperature.

Substituting into the previous equation for the current Iref:

$$Iref = \frac{aV_{BG}\mu_n(T_o)C_{OX}K}{qT_o^{-n}}\left(\frac{W}{L}\right)_{130}T^{1-n} + \frac{ab\mu_n(T_o)C_{OX}K^2}{q^2T_o^{-n}}\left(\frac{W}{L}\right)_{128}T^{2-n}$$

Wherein: K is Boltzmann's constant and those skilled in the art understand that this is temperature independent. The equation for Iref includes $V_{BG}$ which may have a spread of about 35 mV under all process corner and temperature range from −40° C. to 150° C. With a typical value $V_{BG}$=1.25V, the error is about ±1.5% under different process corner.

Accordingly, the equation for Iref can be rewritten as:

$$Iref = \frac{c}{T_o^{-n}}T^{1-n} + \frac{d}{T_o^{-n}}T^{2-n}$$

Wherein: c and d are temperature independent constants dependent on a, b, $V_{BG}$, $\mu_n$, $T_o$, $C_{OX}$, K and the W/L ratios of the transistors 128 and 130.

With reference to the equation for the reference current Iref, the change in current (dIref) over change in temperature (dT) can be calculated:

$$\left.\frac{dIref}{dT}\right|_{T=T_o} = \left[(1-n)\frac{c}{T_o^{-n}}T^{-n} + (2-n)\frac{d}{T_o^{-n}}T^{1-n}\right]_{T=T_o}$$
$$= (1-n)c + (2-n)dT_o$$

In this equation, n is a constant dependent on dopant concentration. A typical value is n=1.5. See, Sze, "Physics of Semiconductor Devices," $2^{nd}$ Edition, 1981, the disclosure of which is incorporated by reference. Thus, the portion of the equation (1−n) will be negative and the portion of the equation (2−n) will be positive. It is accordingly possible to obtain $$\left.\frac{dI_{ref}}{dT}\right|_{T=T_o}$$

equal to zero by appropriately setting the parameters c and d. In other words, the value of the change in current over change in temperature can be driven to zero, making Iref temperature and process compensated, by choosing appropriate characteristics of the two transistors and the applied biasing voltages.

Figure 1:
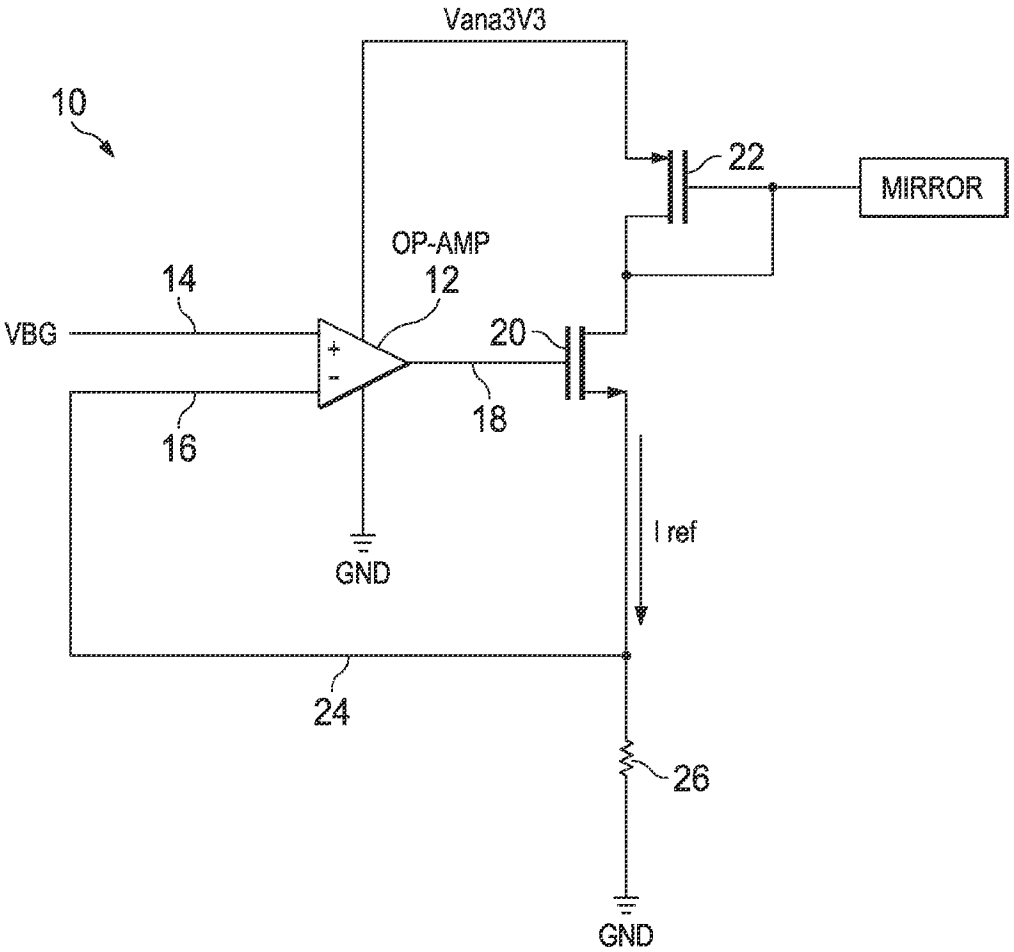
FIG. 1 (PRIOR ART)
FIG. 1 is a circuit diagram of a prior art reference current generator circuit.

It is accordingly noted that the process parameters that affects Iref are both β and $V_{BG}$, where $V_{BG}$ is understood to have some affection but this is relatively very small and the spread of β over process is much smaller (under a given process for example about ±8%) than with resistance (compare to FIG. 1). Advantageously, the circuit 110 of FIG. 2 will have a reference current spread that is much smaller than with the prior art FIG. 1 resistor-based current reference circuit.

Figure 3:
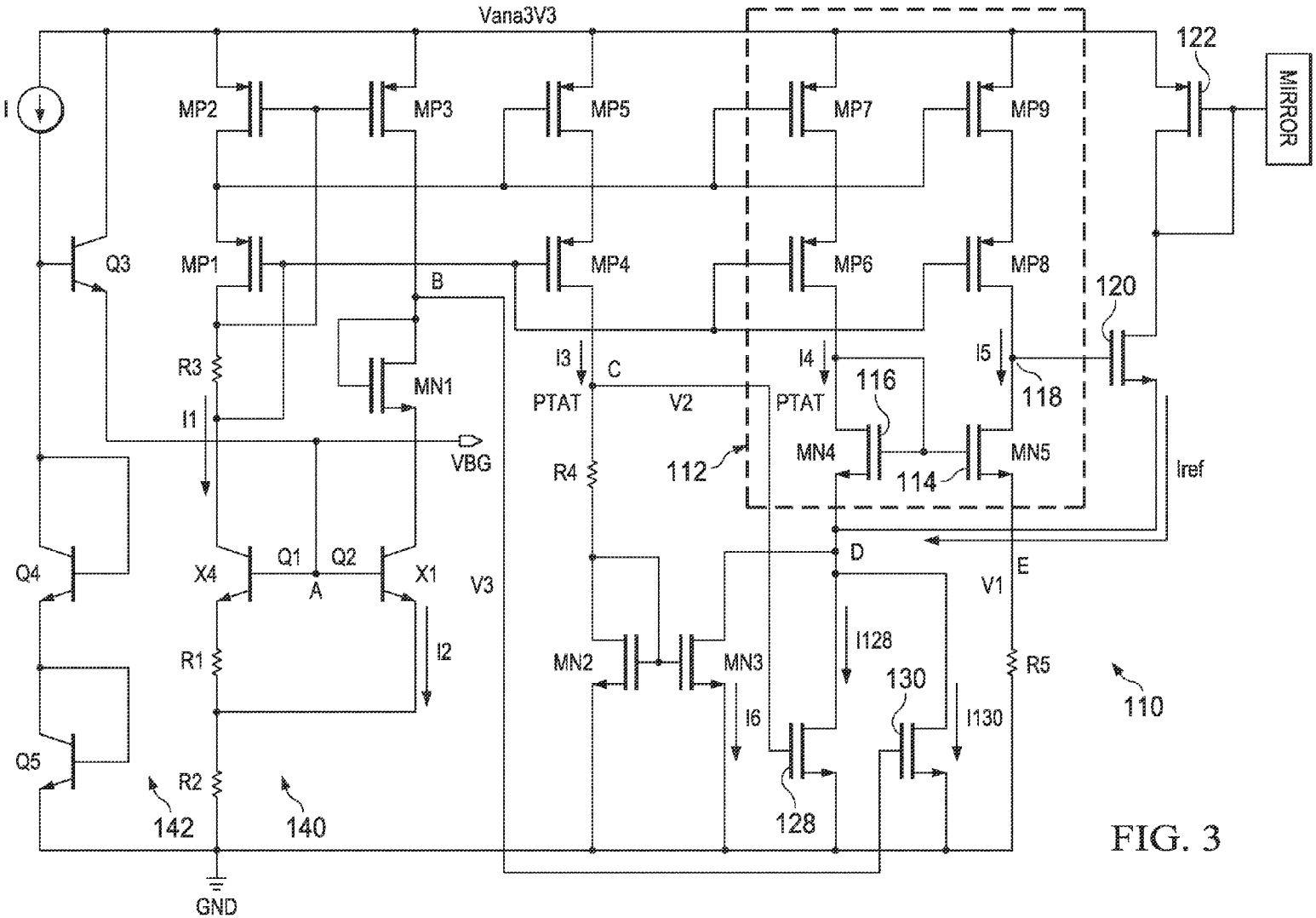
FIG. 3 is a circuit diagram of the temperature and process compensated reference current generator circuit of FIG. 2.

Reference is now made to FIG. 3 which illustrates a circuit diagram for an exemplary implementation of the temperature and process compensated reference current generator circuit 110 of FIG. 2.

The circuit 110 includes a bandgap voltage generator circuit 140 having a conventional configuration (resistors R1 and R2, bipolar transistors Q1 and Q2 and MOSFET transistors MP2 and MP3). The bandgap voltage $V_{BG}$ is generated at node A in a manner well known to those skilled in the art. The current mirror formed by transistors MP2 and MP3 forces the currents I1 and I2 to be equal (in an exemplary implementation equal to approximately 0.5 uA), and both currents I1 and I2 are proportional to absolute temperature (PTAT). The bipolar transistors Q1 and Q2 are used to compensate for the temperature variation in the bandgap voltage at the connected base terminals. The transistors Q1 and Q2 have different emitter areas, in the illustrated example with a ratio of 4:1. The resistances of the resistors R1 and R2 are further ratioed.

A transistor MN1 has its source-drain path coupled in series between the transistor Q2 and the transistor MP3. The gate of transistor MN1 is connected to the drain of transistor MN1. Transistor MN1 is accordingly a diode-connected device. By properly sizing transistor MN1, the gate-to-source voltage of transistor MN1 will be approximately equal to a threshold voltage ($V_{th}$). Thus, the voltage at node B will equal the third reference voltage $V3 \approx V_{BG}+V_{th}$.

To ensure proper operation of the bandgap voltage generator circuit 140, a start-up circuit 142 is included formed of current source I, bipolar transistor Q3, and diode-connected bipolar transistors Q4 and Q5. Transistor Q3 is biased to source current from its emitter terminal into the connected base terminals of transistors Q1 and Q2 with the injected base current serving to ensure that the bandgap voltage generator circuit 140 starts in the stable operating state.

The active load of the bandgap voltage generator circuit 140 is of a cascode design which includes cascode transistor MP1 and resistor R3. Transistor MP1 has its source-drain path coupled in series with the source-drain path of transistor MP2. The gate of transistor MP2 is connected to the drain of transistor MP1 and a first end of the resistor R3. The gate of transistor MP1 is connected to the second end of the resistor R3. The circuit accordingly forms a high output swing current mirror as known in the art.

The current I1 flowing in transistors MP1 and MP2 is mirrored through transistors MP4 and MP5 to generate a current I3 that is also PTAT. The transistors MP4 and MP5 have their source-drain paths coupled in series, with the gate of transistor MP4 coupled to the gate of transistor MP1 and the gate of transistor MP5 coupled to the gate of transistor MP2. The transistor MP4, like the transistor MP1, is a cascode device. The W/L of transistors MP4 and MP5 is larger than the W/L of transistors MP1 and MP2 by a desired ratio. Thus, the current mirror functions to multiply the current I1 by that ratio in generating the current I3. In an exemplary implementation, the ratio is 4:1 and thus I3=4*I1=2.0 uA.

The current I3 is applied across a resistor R4. The voltage drop across resistor R4 is equal to R4*I3=b$V_T$. Because the current I3 is PTAT and equal to $V_T$ ln N/R1n (where N is the emitter area ratio), the voltage drop across resistor R4 is $$V_{R4} = \frac{R4}{R1} V_T \mathrm{Ln}(n).$$

A transistor MN2 has its source-drain path coupled in series between the resistor R4 and the negative voltage supply node. Transistor MN2 is an n-channel MOSFET device. The gate of transistor MN2 is connected to the drain of transistor MN2. Transistor MN2 is accordingly a diode-connected device. By properly sizing transistor MN2, the gate-to-source voltage of transistor MN2 will be approximately equal to a threshold voltage ($V_{th}$). Thus, the voltage at node C will equal the second reference voltage V2≈b$V_T$+$V_{th}$, wherein b$V_T$=$V_{R4}$.

The gate of transistor MN2 is coupled to the gate of transistor MN3. Transistor MN2 is an n-channel MOSFET device. The source terminals of transistors MN2 and MN3 are connected to the negative voltage supply node. Thus, transistors MN2 and MN3 are configured as a current mirror circuit. Thus the current I3 is mirrored through transistors MN2 and MN3 to current I6. The W/L of transistor MN3 is larger than the W/L of transistor MN2 by a desired ratio. Thus, the current mirror functions to divide the current I3 by that ratio in generating the current I6. In an exemplary implementation, the ratio is 1:4 and thus I6=1/4*I3=0.5 uA. The current I6 should be equal to the current I4 which is a PTAT current.

The operational amplifier 112 is formed by transistors MN4, MN5, MP6, MP7, MP8 and MP9. The source-drain paths of transistors MN4, MP6 and MP7 are coupled in series between the inverting input node 116 and the positive voltage supply node. The source-drain paths of transistors MN5, MP8 and MP9 are coupled in series between the non-inverting input node 114 and the positive voltage supply node. Transistors MN4 and MN5 are n-channel MOSFET devices. The gates of transistors MN4 and MN5 are coupled together and the drain of transistor MN4 is coupled to the gate of transistor MN4. The W/L of transistor MN4 is equal to the W/L of transistor MN5. Transistors MP6, MP7, MP8 and MP9 are p-channel MOSFET devices. The current I1 flowing in transistors MP1 and MP2 is mirrored through transistors MP6 and MP7 to generate a current I4 that is also PTAT. The gate of transistor MP6 is coupled to the gate of transistor MP1 and the gate of transistor MP7 is coupled to the gate of transistor MP2. The transistor MP6, like the transistor MP1, is a cascode device. The W/L of transistors MP6 and MP7 is the same as the W/L of transistors MP1 and MP2. Thus, the current mirror functions to copy the current I1 in generating the current I4 (i.e., I1=I4=0.5 uA). The current I1 flowing in transistors MP1 and MP2 is mirrored through transistors MP8 and MP9 to generate a current I5 that is also PTAT. The gate of transistor MP8 is coupled to the gate of transistor MP1 and the gate of transistor MP9 is coupled to the gate of transistor MP2. The transistor MP8, like the transistor MP1, is a cascode device. The W/L of transistors MP8 and MP9 is the same as the W/L of transistors MP1 and MP2. Thus, the current mirror functions to copy the current I1 in generating the current I5 (i.e., I1=I5=0.5 uA). The output node 118 of the amplifier 112 is taken at the drain terminal of transistor MN5.

A resistor R5 is coupled between the non-inverting input node 114 and the negative voltage supply node. The current I5 flows through the resistor R5 and develops the first reference voltage V1=I5*R5=a$V_T$ at the non-inverting input node 114 of the amplifier 112 (node E). Because the current I5 is PTAT and equal to $V_T$ ln N/R1 (where N is the emitter area ratio), the voltage drop across resistor R5 is $$V_{R5} = \frac{R5}{R1} V_T \mathrm{Ln}(n).$$

It will accordingly be appreciated that the values of a and b can be configured by choosing the resistance relationship of resistors R4 and R5 to resistor R1.

The amplifier 112 functions, in conjunction with the transistor 120 coupled to the amplifier output 118, to force the voltage at node D (at the inverting input node 116 of the amplifier 112) to be equal to the voltage at node E.

The current mirror formed by transistors MN2 and MN3 is configured, as discussed above, to produce the current I6 having a magnitude equal to the current I4 (i.e., =0.5 uA). The node D functions as a current summing node wherein: Iref+I4=I6+I128+I130. Because I4=I6, then Iref=I128+I130. As discussed above and mathematically illustrated, it is possible to configure transistors 128 and 130 to provide a temperature and process compensated reference current Iref. That reference current Iref can then be mirrored through the transistor 122 as needed.

In summary, the circuits of FIGS. 2 and 3 provide a current reference circuit that uses two triode region n-channel MOSFET transistors 128 and 130, gate biased by different voltages (V2 and V3), such that the two transistors generate currents with different and opposite temperature coefficients. The sum of the currents generated by the two transistors, which is equal to a reference current suited for replication and scaling, will have a very low temperature coefficient. The current reference is dependent on the process parameter β for the MOSFET transistors, and this parameter in understood to have a low dependency on process variation.

Figure 4:
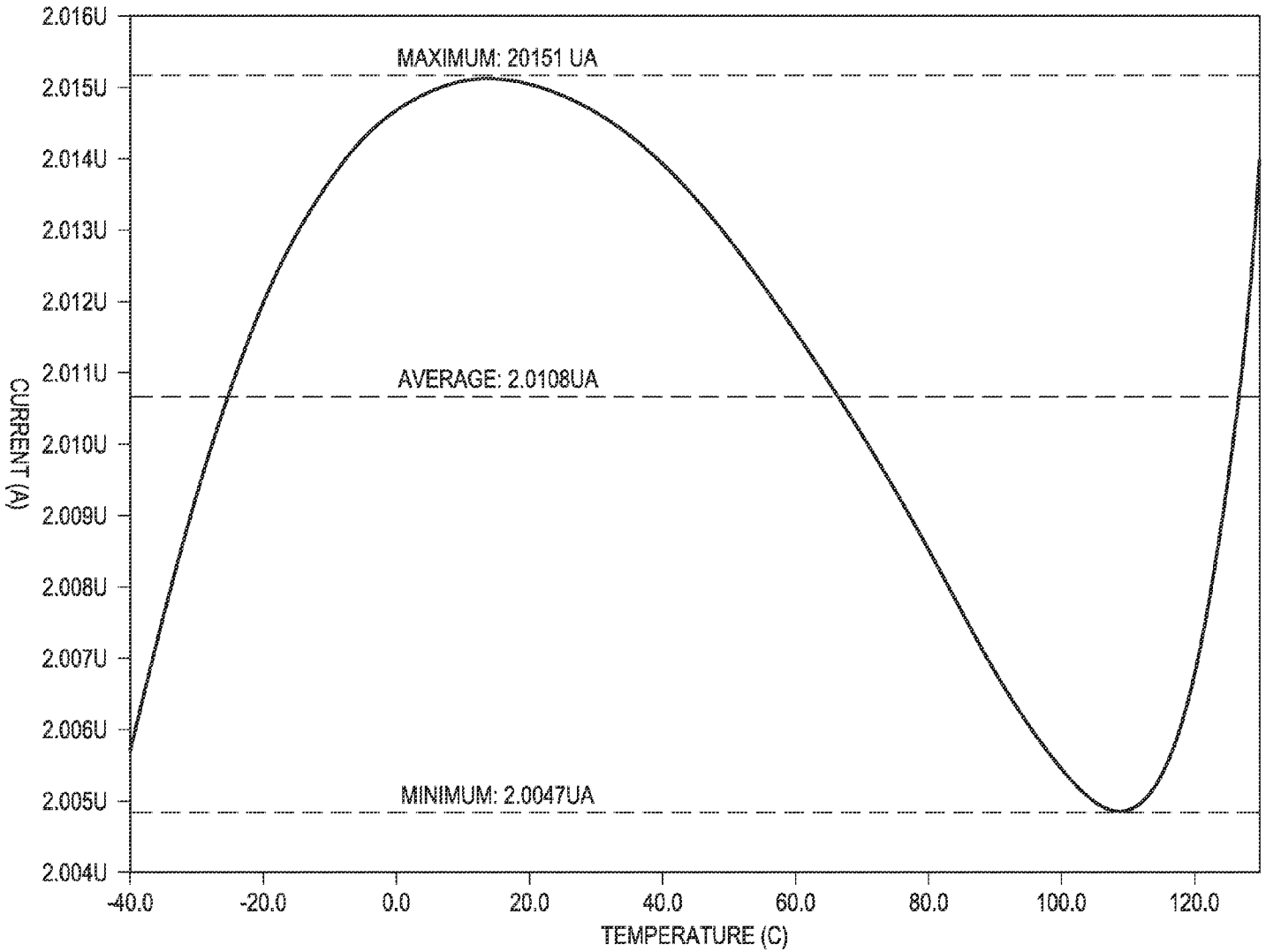
FIGS. 4 and 5 are graphs illustrating operation of the circuit of FIG. 3 to generate a reference current as a function of temperature and process corner.

The circuit of FIG. 3 was simulated and the output reference current Iref determined over a range of temperatures. FIG. 4 is a graph illustrating the generated reference current Iref as a function of temperature (over a range from −40° C. to 130° C.). The average current value is 2.0108 uA, with a maximum current of 2.0151 uA and a minimum current of 2.0047 uA over the temperature range. These results illustrate a temperature coefficient for the circuit 110 of:

$$\begin{aligned} TC_F &= \frac{1}{I_{ref}} \frac{I\max - I\min}{T\max - T\min} \\ &= \frac{1}{2.0108} \frac{2.0151 - 2.0047}{130 + 40} \\ &= 30_{ppm/°C.} \end{aligned}$$

Figure 5:
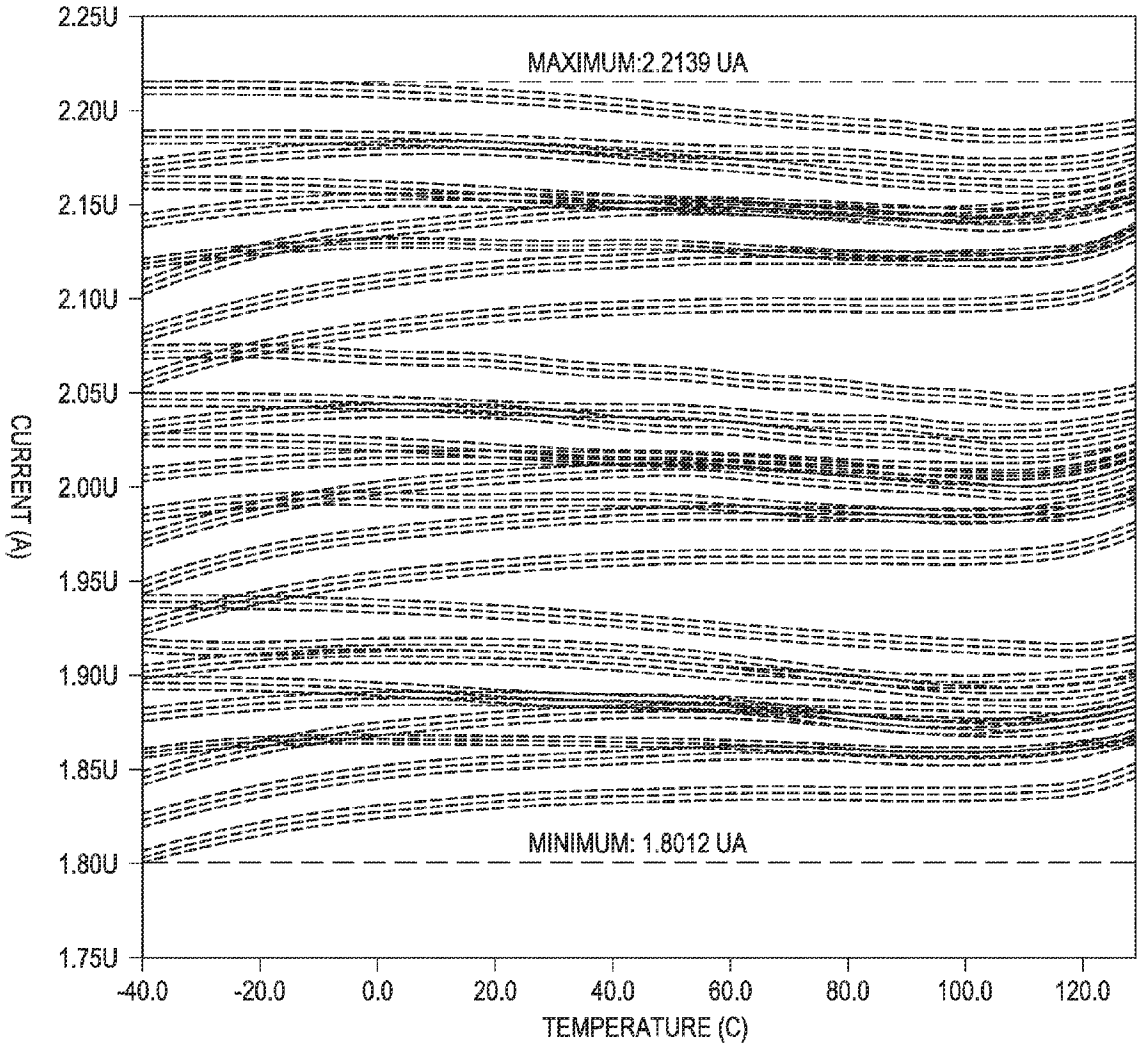

FIG. 5 is a graph illustrating operation of the simulated circuit of FIG. 3 over a range of temperatures from −40° C. to 130° C. for a number of different process corners. The illustration in FIG. 5 shows a maximum current of 2.2139 uA and a minimum current of 1.8012 uA over all process corners. So, Imax=2.0108+10.1% and Imin=2.0108-10.4% with respect to process variation.

Figure 6:
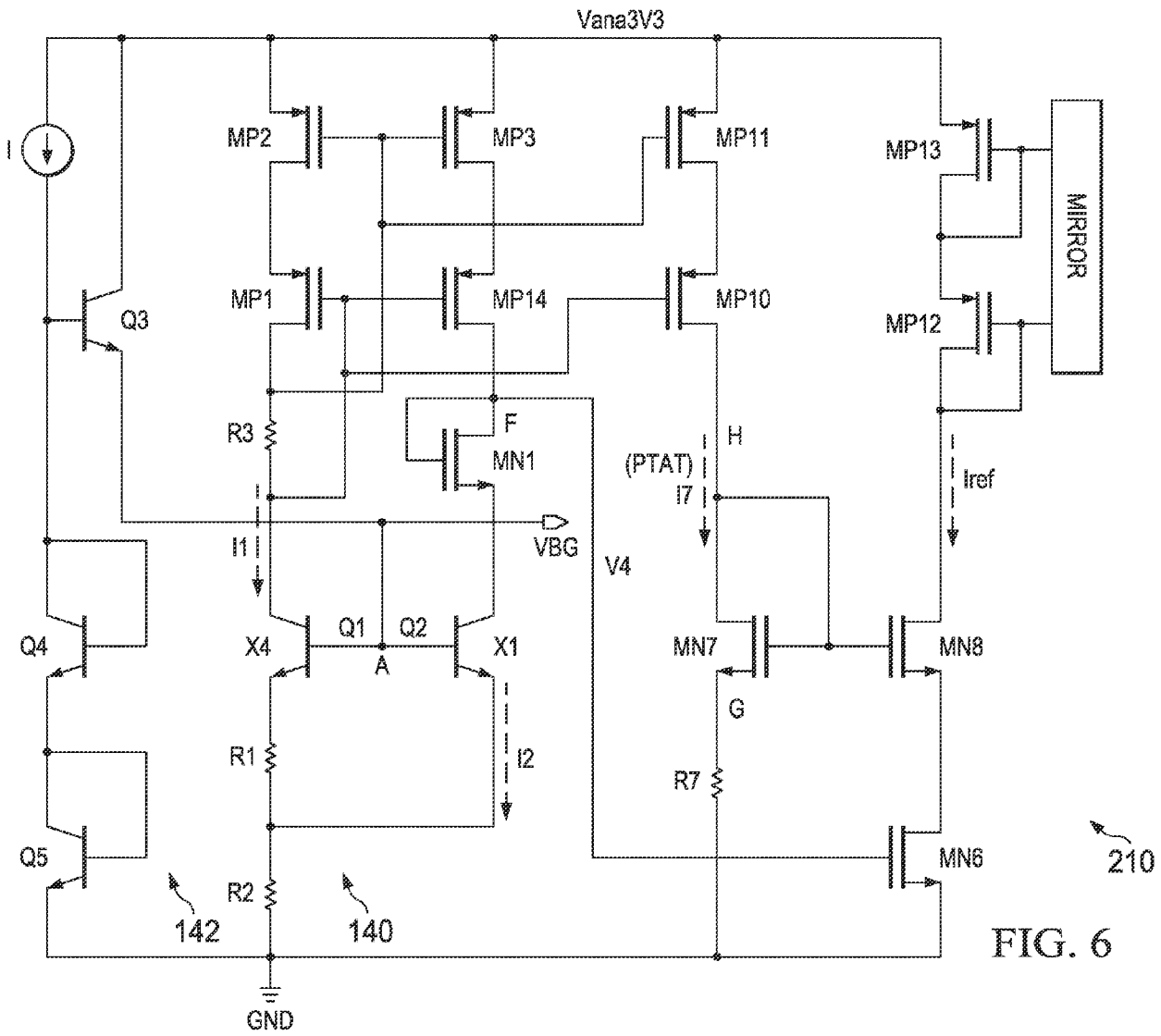
FIG. 6 is a circuit diagram of an embodiment of a temperature and process compensated reference current generator circuit.

Reference is now made to FIG. 6 which illustrates a circuit diagram for an exemplary implementation of a temperature and process compensated reference current generator circuit 210.

The circuit 210 includes a bandgap voltage generator circuit 140 having a conventional configuration (resistors R1 and R2, bipolar transistors Q1 and Q2 and MOSFET transistors MP2 and MP3). The bandgap voltage $V_{BG}$ is generated at node A in a manner well known to those skilled in the art. The current mirror formed by transistors MP2 and MP3 forces the currents I1 and I2 to be equal (in an exemplary implementation equal to approximately 0.5 uA), and both currents I1 and I2 are PTAT. The bipolar transistors Q1 and Q2 are used to compensate for the temperature variation in the bandgap voltage at the connected base terminals. The transistors Q1 and Q2 have different emitter areas, in the illustrated example with a ratio of 4:1. The resistances of the resistors R1 and R2 are further ratioed.

A transistor MN1 has its source-drain path coupled in series between the transistor Q2 and the transistor MP3. The gate of transistor MN1 is connected to the drain of transistor MN1. Transistor MN1 is accordingly diode-connected device. By properly sizing transistor MN1, the gate-to-source voltage of transistor MN1 will be approximately equal to a threshold voltage ($V_{th}$). Thus, the voltage at node F will equal a fourth reference voltage $V4=V_{BG}+V_{th}$.

To ensure proper operation of the bandgap voltage generator circuit 140, a start-up circuit 142 is included formed of current source I, bipolar transistor Q3, and diode-connected bipolar transistors Q4 and Q5. Transistor Q3 is biased to source current from its emitter terminal into the connected base terminals of transistors Q1 and Q2 with the injected base current serving to ensure that the bandgap voltage generator circuit 140 starts in the stable operating state.

The active load of the bandgap voltage generator circuit 140 is of a cascode design which includes cascode transistor MP1 and a cascade transistor MP14. Transistor MP1 has its source-drain path coupled in series with the source-drain path of transistor MP2. The gate of transistor MP2 is connected to the drain of transistor MP1 and a first end of the resistor R3 and to the gate of transistor MP3. The gate of transistor MP1 is connected to the second end of the resistor R3 and to the gate of transistor MP14. The transistor MP14 has its source-drain path coupled in series with the source-drain path of transistor MP3.

The current I1 flowing in transistors MP1 and MP2 is mirrored through transistors MP10 and MP11 to generate a current I7 that is also PTAT. The transistors MP10 and MP11 have their source-drain paths coupled in series, with the gate of transistor MP10 coupled to the gate of transistor MP1 and the gate of transistor MP11 coupled to the gate of transistor MP2. The transistor MP10, like the transistor MP1, is a cascode device. The W/L of transistors MP10 and MP11 is larger than the W/L of transistors MP1 and MP2 by a desired ratio. Thus, the current mirror functions to multiply the current I1 by that ratio in generating the current I7. In an exemplary implementation, the ratio is 2:1 and thus I7=2*I1=1.0 uA.

The current I7 is applied across a resistor R7. The voltage drop across resistor R7 at node G is equal to R7*I7. A transistor MN7 has its source-drain path coupled in series with the resistor R7 between the positive voltage supply node and the negative voltage supply node. Transistor MN7 is an n-channel MOSFET device. The gate of transistor MN7 is connected to the drain of transistor MN7. Transistor MN7 is accordingly a diode-connected device. By properly sizing transistor MN7, the gate-to-source voltage of transistor MN7 will be approximately equal to a threshold voltage ($V_{th}$). Thus, the voltage at node H will equal $V_{R7}+V_{th}$.

The gate of transistor MN7 is coupled to the gate of transistor MN8. Transistor MN8 is an n-channel MOSFET device. The source-drain path of transistor MN8 is coupled in series with the source-drain path of transistor MN6. Transistor MN6 is also an n-channel MOSFET device. The gate terminal of transistor MN6 is coupled to node F, and thus is biased by the voltage $V4\approx V_{BG}+V_{th}$. The generated reference current Iref flows through transistors MN6 and MN8.

A transistor MP12 has its source-drain path coupled in series with the transistors MN6 and MN8, and thus it also carries the reference current Iref. The transistor MP12 is a p-channel MOSFET configured as a cascode device. The gate of transistor MP12 is coupled to the drain of transistor MP12. Transistor MP12 is accordingly also a diode-connected device. A transistor MP13 has its source-drain path coupled in series with the transistor MP12, and thus it also carries the reference current Iref. The gate of transistor MP13 is coupled to the drain of transistor MP13. Transistor MP13 is accordingly a diode-connected device. The transistors MP12 and MP13 are each input transistors for current mirror circuits used to replicate and scale the reference current Iref in a manner well known to those skilled in the art.

The voltage drop on resistor R7 is a PTAT voltage:

$$V_{R7} = \frac{R7}{R1} V_T \mathrm{Ln}(n)$$

If the size of transistors MN1 and MN2 are relatively large, then the gate-to-source voltage of MN1 and M2 will be approximately the threshold voltage $V_{TH}$. The transistor MN6 operates in the triode region with an on resistance equal to:

$$\begin{aligned} R_{MN\,6} &= \frac{1}{\mu_n C_{ox}\left(\frac{W}{L}\right)_{MN\,6}(V_{GS}-V_{TH})} \\ &\approx \frac{1}{\mu_n C_{ox}\left(\frac{W}{L}\right)_{MN\,6} VBG} \\ &= \frac{1}{\beta_6 VBG} \end{aligned}$$

The current of Iref has the following equations:

$$Vgs(MN7) + V_{R7} = Vgs(MN8) + Vds(MN6)$$

$$V_{TH} + \frac{R7}{R1} V_T \mathrm{Ln}(n) \approx V_{TH} + \sqrt{\frac{2I_{ref}}{\beta_8}} + \frac{I_{ref}}{\beta_6(VBG)}$$

$$\frac{R7}{R1} V_T \mathrm{Ln}(n) \approx \sqrt{\frac{2I_{ref}}{\beta_8}} + \frac{I_{ref}}{\beta_6(VBG)}$$

Set $$a = \frac{R4}{R1}\mathrm{Ln}(n),$$

wherein a is a temperature and process independent parameter.

The foregoing equation can then be rewritten as:

$$aV_T = \sqrt{\frac{2I_{ref}}{\beta_8}} + \frac{I_{ref}}{\beta_6(VBG)}$$

$$\frac{1}{\beta_6(VBG)}\left(\sqrt{I_{ref}}\right)^2 + \sqrt{\frac{2}{\beta_8}}\sqrt{I_{ref}} - aV_T = 0$$

Solving the equation for Iref:

$$\sqrt{I_{ref}} = \frac{\beta_6(VBG)}{2}\left[-\sqrt{\frac{2}{\beta_8}} + \sqrt{\frac{2}{\beta_8} + \frac{4aV_T}{\beta_6(VBG)}}\right]$$

$$I_{ref} = aV_T\beta_6(VBG) + \frac{\beta_6^2(VBG)^2}{\beta_8}\left[1 - \sqrt{1 + \frac{2aV_T\beta_8}{\beta_6(VBG)}}\right]$$

In an embodiment, $$\left(\frac{W}{L}\right)_{MN8} = \frac{5u}{100u}, \left(\frac{W}{L}\right)_{MN6} = \frac{5u}{120u}, \text{ so } \frac{\beta_8}{\beta_6} = \frac{6}{5}.$$

The typical value for $V_T$ is 26 mV (for example, at 27° C.). So, $$\frac{V_T\beta_8}{\beta_6(VBG)} = \frac{6*0.026}{5*(1.25)} = 0.025 << 1.$$

Setting $$\frac{V_T\beta_8}{\beta_6(VBG)} = x,$$

and expanding in Taylor series at zero neglecting the parts with a higher order than 3:

$$\sqrt{1+2ax} \approx f(0) + f'(0)x + \frac{1}{2}f''(0)x^2 + \frac{1}{6}f'''(0)x^3$$

$$= 1 + ax - \frac{1}{2}a^2x^2 + \frac{1}{2}a^3x^3$$

and $$x = \frac{V_T\beta_8}{\beta_6(VBG)}.$$

This gives:

$$\sqrt{1 + \frac{2aV_T\beta_8}{\beta_6(VBG)}} \approx$$

-continued $$1 + a\frac{V_T\beta_8}{\beta_6(VBG)} - \frac{1}{2}a^2\left[\frac{V_T\beta_8}{\beta_6(VBG)}\right]^2 + \frac{1}{2}a^3\left[\frac{V_T\beta_8}{\beta_6(VBG)}\right]^3$$

With respect to Iref then:

$$I_{ref} = aV_T\beta_6(VBG) + \frac{\beta_6^2(VBG)^2}{\beta_8}\left[1 - \sqrt{1 + \frac{2aV_T\beta_8}{\beta_6(VBG)}}\right]$$

$$I_{ref} \approx \frac{1}{2}a^2\beta_8V_T^2 - \frac{1}{2}a^3\frac{\beta_8}{\beta_6}\beta_8\frac{V_T^3}{(VBG)}$$

The mobility of the average electron in an n-channel MOSFET is:

$$\mu_n(T) = \mu_n(T_o)\left(\frac{T}{T_o}\right)^{-n}$$

wherein $$\beta = \mu_nC_{ox}\left(\frac{W}{L}\right).$$

The equation for Iref may then be rewritten as:

$$I_{ref} = \frac{1}{2}a^2\frac{\mu_n(T_o)C_{ox}}{T_o^{-n}}\left(\frac{W}{L}\right)_{MN8}\left(\frac{k}{q}\right)^2T^{2-n} - \frac{1}{2}a^3\frac{\beta_8}{\beta_6}\frac{\mu_n(T_o)C_{ox}}{T_o^{-n}}\left(\frac{W}{L}\right)_{MN8}\left(\frac{k}{q}\right)^3T^{3-n}\frac{1}{(VBG)}$$

Taking the change in Iref over the change in temperature:

$$\frac{dI_{ref}}{dT}\Big|_{T=T_o} = \frac{1}{2}(2-n)a^2\mu_n(T_o)C_{ox}\left(\frac{W}{L}\right)_{MN8}\left(\frac{k}{q}\right)^2T_o^2 - \frac{1}{2}(3-n)a^3\frac{\beta_8}{\beta_6}\mu_n(T_o)C_{ox}\left(\frac{W}{L}\right)_{MN8}\left(\frac{k}{q}\right)^3T_o^3\frac{1}{(VBG)}$$

Setting $$\frac{dI_{ref}}{dT}\Big|_{T=T_o} = 0,$$

the equation may be solved as follows:

$$2 - n = a\frac{3-n}{(VBG)}\frac{\beta_8}{\beta_6}V_T(T_o)$$

and $$a = \frac{2-n}{3-n}\frac{\beta_6}{\beta_8}\frac{(VBG)}{V_T(T_o)}$$

The typical value of n=1.5. So, 2−n and 3−n are both positive constants. By setting the value of parameter a, a relative temperature stable reference current can be obtained. Since VBG is a comparatively stable voltage over temperature and process (simulation result show that the VBG common spread is ±1.5% over process from −40° C. to 150° C.), the process parameter that affects Iref is β. The spread of β over process is much smaller than for a resistor. So, this reference current spread much smaller than a resistor based current reference like that of the prior art.

Figure 7:
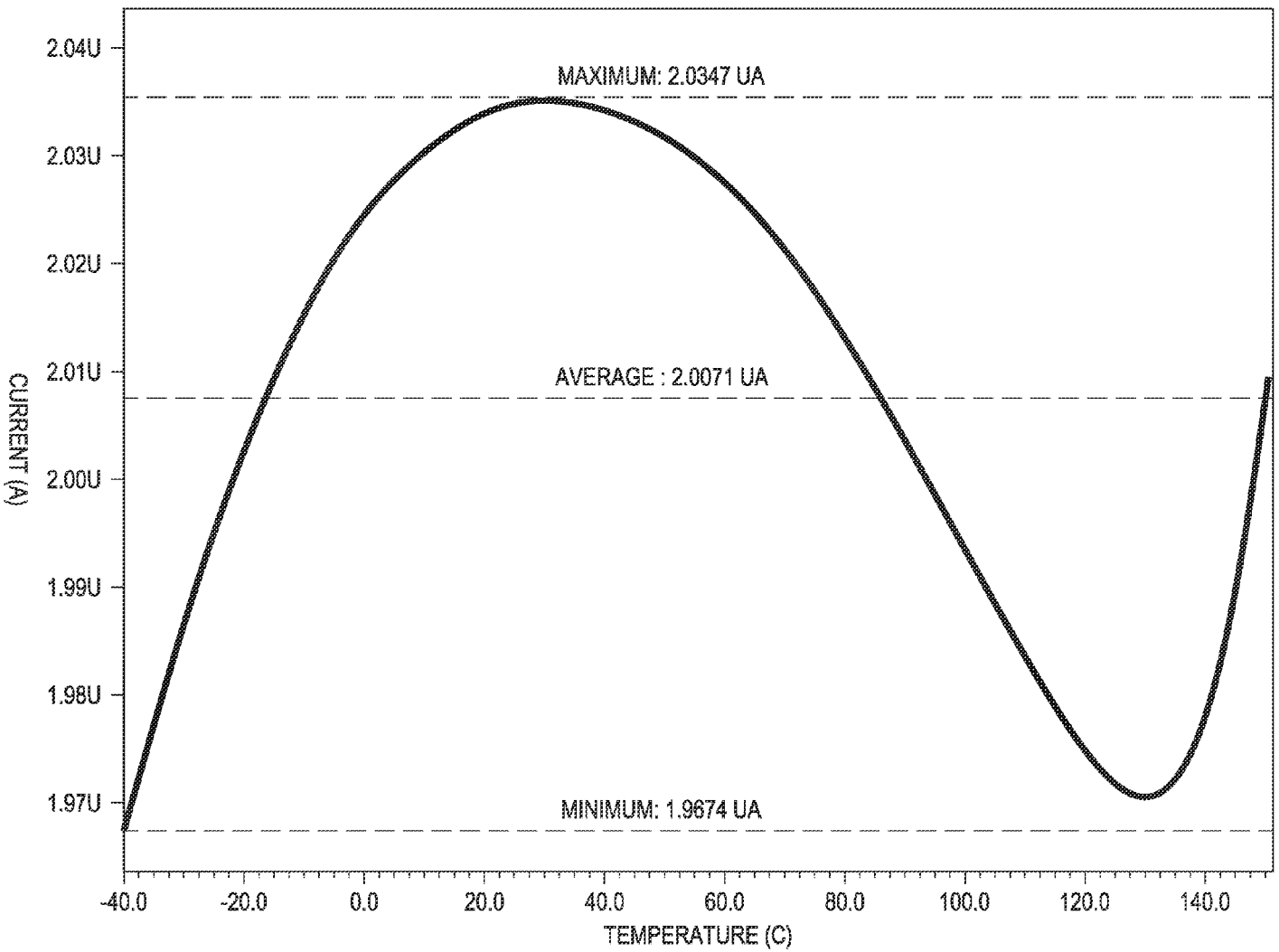
FIGS. 7 and 8 are graphs illustrating operation of the circuit of FIG. 6 to generate a reference current as a function of temperature and process corner.

The circuit of FIG. 6 was simulated and the output reference current Iref determined over a range of temperatures. FIG. 7 is a graph illustrating the generated reference current Iref as a function of temperature (over a range from −40° C. to 150° C.). The average current value is 2.007 uA, with a maximum current of 2.034 uA and a minimum current of 1.967 uA over the temperature range. These results illustrate a temperature coefficient for the circuit 210 of:

$$TC_F = \frac{1}{I_{ref}} \frac{I\max - I\min}{T\max - T\min} = \frac{1}{2.007} \frac{2.034 - 1.967}{150 + 40} = 175 \text{ ppm/° C.}$$

Figure 8:
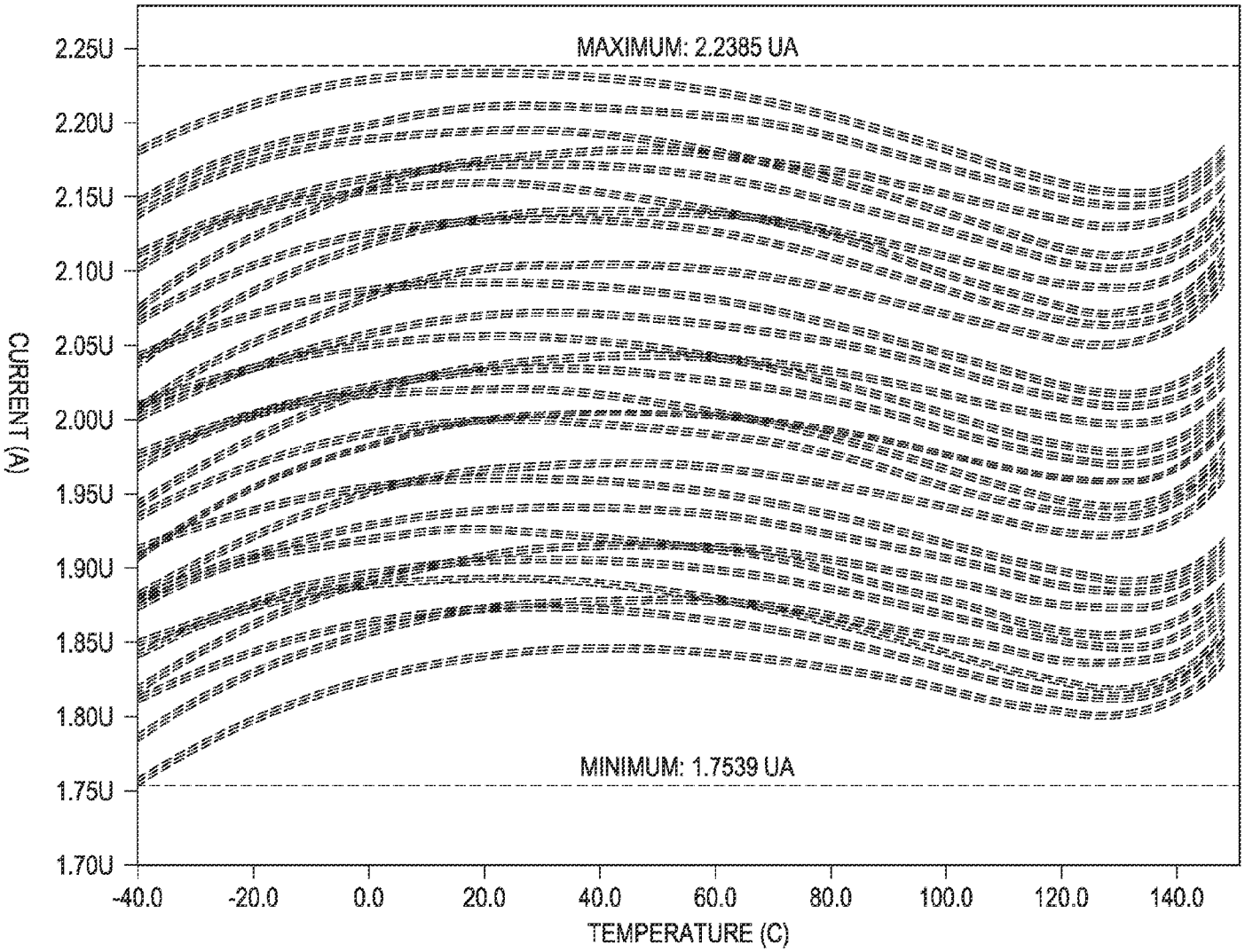

FIG. 8 is a graph illustrating operation of the simulated circuit of FIG. 6 over a range of temperatures from −40° C. to 150° C. for a number of different process corners. The illustration in FIG. 8 shows a maximum current of 2.238 uA and a minimum current of 1.754 uA over all process corners. So, Imax=2.007+11.5% and Imin=2.007-12.6% with respect to process variation.

In the disclosure herein, operations of circuit embodiment(s) may be described with reference to method embodiment(s) for illustrative purposes. However, it should be appreciated that the operations of the circuits and the implementations of the methods in the disclosure may be independent of one another. That is, the disclosed circuit embodiments may operate according to other methods and the disclosed method embodiments may be implemented through other circuits.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacturing, compositions of matter, means, methods, or steps.

What is claimed is:

1. A circuit, comprising:

a reference current path configured to carry a reference current;

a first transistor coupled to the reference current path and configured to carry at first portion of the reference current, said first transistor having a control terminal configured to be biased by a first voltage derived from a bandgap voltage; and a second transistor coupled to the reference current path and configured to carry a second portion of the reference current, said second transistor having a control terminal configured to be biased by a second voltage derived from a proportional to absolute temperature (PTAT) voltage;

wherein the first and second transistors are coupled in parallel with each other; and wherein a temperature coefficient of the current flowing in the first transistor and a temperature coefficient of the current flowing in the second transistor are opposite.

2. The circuit of claim 1, further comprising a bandgap reference voltage generator circuit configured to generate the bandgap voltage.

3. The circuit of claim 1, further comprising a bandgap reference voltage generator circuit configured to generate a first current and including a circuit configured to generate the first voltage by passing the first current across a diode-connected transistor.

4. The circuit of claim 3, further including a mirror circuit configured to generate a second current mirrored from the first current, and an additional circuit configured to generate the second voltage by passing the second current across a resistor.

5. The circuit of claim 4, wherein the additional circuit is further configured to generate the second voltage by passing the second current across a diode connected transistor coupled in series with the resistor.

6. The circuit of claim 5, wherein the diode connected transistor has a control terminal coupled to the control terminal of the second transistor.

7. The circuit of claim 1, further including:

an operational amplifier having a first input configured to receive a reference voltage and a second input coupled to the parallel coupled first and second transistors; and a third transistor having a control terminal coupled to an output of the operational amplifier, the third transistor defining the reference current path and coupled in series with the parallel coupled first and second transistors.

8. The circuit of claim 7, wherein the operational amplifier is configured to supply an additional current to the second input of the operational amplifier, the circuit further including a current source configured to generate an offset current applied to the second input of the operational amplifier, the offset current being substantially equal to the additional current.

9. The circuit of claim 8, further including a current mirror circuit including said current source, the current mirror circuit configured to mirror a current derived from the first voltage to generate said offset current.

10. A circuit, comprising:

an output transistor configured to carry a reference current;

a first transistor coupled in series with the output transistor to carry a first portion of the reference current;

a second transistor coupled in series with the output transistor to carry a second portion of the reference current;

wherein the first and second transistors are coupled in parallel to each other;

a bandgap reference voltage generator circuit configured to generate a bandgap reference voltage;

a first biasing circuit configured to generate a first biasing voltage for application to a control terminal of the first transistor, said first biasing voltage derived from said bandgap reference voltage; and a second biasing circuit configured to generate a second biasing voltage for application to a control terminal of the second transistor, said second biasing voltage generated from a proportional to absolute temperature (PTAT) current mirrored from a current flowing in the bandgap reference voltage generator circuit;

wherein a temperature coefficient of the current flowing in the first transistor and a temperature coefficient of the current flowing in the second transistor are opposite.

11. The circuit of claim 10, further comprising:

an operational amplifier having a first input configured to receive a reference voltage and a second input coupled to the parallel coupled first and second transistors; and wherein the output transistor has a control terminal coupled to an output of the operational amplifier.

12. The circuit of claim 10, wherein the first biasing circuit is configured to generate the first biasing voltage by passing a current within the bandgap reference voltage generated circuit across a diode-connected transistor.

13. The circuit of claim 10, wherein the second biasing circuit is configured to generate the second biasing voltage by passing the PTAT current across a resistor.

14. The circuit of claim 13, wherein the second biasing circuit is further configured to generate the second biasing voltage by passing the PTAT current across a diode connected transistor coupled in series with the resistor.

15. The circuit of claim 11, wherein the operational amplifier is further configured to supply an additional current to the second input of the operational amplifier, the circuit further including a current source configured to generate an offset current applied to the second input of the operational amplifier, the offset current being substantially equal to the additional current.

16. The circuit of claim 15, further including a current mirror circuit including said current source, the current mirror circuit configured to mirror the second current to generate said offset current.

17. A circuit, comprising:

a reference current path configured to carry a reference current;

a first transistor coupled in series with the reference current path to carry the reference current;

a second transistor coupled in series with the first transistor to the reference current;

a bandgap reference voltage generator circuit configured to generate a bandgap reference voltage;

a first biasing circuit configured to generate a first biasing voltage for application to a control terminal of the first transistor, said first biasing voltage derived from said bandgap reference voltage; and a second biasing circuit configured to generate a second biasing voltage for application to a control terminal of the second transistor, said second biasing voltage generated from a proportional to absolute temperature (PTAT) current mirrored from a current flowing in the bandgap reference voltage generator circuit.

18. The circuit of claim 17, wherein the first biasing circuit is configured to generate the first biasing voltage in excess of the bandgap reference voltage.

19. The circuit of claim 17, wherein the first biasing circuit is configured to generate the first biasing voltage by passing the current flowing in the bandgap reference voltage generator circuit across a diode-connected transistor.

20. The circuit of claim 17, wherein the second biasing voltage is developed by passing the proportional to absolute temperature (PTAT) current across a resistor.

21. The circuit of claim 20, wherein the second voltage is further developed by passing the PTAT current across a diode connected transistor coupled in series with the resistor.

22. The circuit of claim 21, wherein the diode connected transistor has a control terminal coupled to the control terminal of the second transistor.

* * * * *